US007083478B1

(12) United States Patent
Kutsuna et al.

(10) Patent No.: US 7,083,478 B1
(45) Date of Patent: Aug. 1, 2006

(54) TERMINAL HOLDING STRUCTURE OF BOARD MOUNTED-TYPE CONNECTOR

(75) Inventors: Yoji Kutsuna, Haibara-gun (JP); Kenichi Ouchi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/210,697

(22) Filed: Aug. 25, 2005

(51) Int. Cl.
*H01R 13/40* (2006.01)

(52) U.S. Cl. ..... 439/733.1

(58) Field of Classification Search ..... 439/733.1, 439/444, 572, 751
See application file for complete search history.

(56) References Cited

U.S. PATENT DOCUMENTS 4,464,007 A * 8/1984 Parmer ..... 439/389
5,989,075 A * 11/1999 Hsiao et al. ..... 439/733.1
6,042,429 A * 3/2000 Bianca et al. ..... 439/733.1

FOREIGN PATENT DOCUMENTS

JP 2000-243495 A 9/2000

* cited by examiner

*Primary Examiner*—Phuong Dinh
(74) *Attorney, Agent, or Firm*—Sughrue Mion, PLLC

(57) ABSTRACT

A terminal for a board mounted-type connector. The terminal including retaining portion to retain the terminal in the terminal retaining holes (4). The retaining portion includes a pair of rear retaining projections (1*d*) which are formed on and project laterally respectively from opposite sides of the board mounted-type terminal (1), and a pair of front retaining projections (1*c*) which are formed on and project laterally respectively from the opposite sides of the board mounted-type terminal. The rear retaining projections (1*d*) and the front retaining projections (1*c*) are different in shape from each other.

4 Claims, 5 Drawing Sheets

TERMINAL HOLDING STRUCTURE OF BOARD MOUNTED-TYPE CONNECTOR

BACKGROUND OF THE INVENTION

1. Field of the Invention

This invention relates to a terminal structure used for electrically connecting various equipments mounted on an automobile, and more particularly to a terminal holding structure of a board mounted-type connector employing square wire members press-fitted and held in a terminal holding wall of a connector housing.

2. Related Art

There are known various conventional terminal holding structures in which board mounted-type terminals (for mounting on a board), each comprising a square wire member, are press-fitted and held in a terminal holding wall of a connector housing. For example, in a board mounted-type terminal structure disclosed in JP-A-2000-243495, a board mounted-type terminal is formed from a square wire material, and is press-fitted and held in one of a plurality of terminal holding holes formed through a terminal holding wall of a connector housing, and a pair of first retaining projections for pressing (orbiting) respectively into opposed side surfaces of the terminal holding hole are formed on and project laterally from a retaining portion of the board mounted-type terminal which is to be held in the terminal holding hole, and further a second projection for pressing (or biting) into at least one of a top surface or a bottom surface of the terminal holding hole is formed on and projects vertically from the retaining portion of the board mounted-type terminal which is to be held in the terminal holding hole.

In the board mounted-type connector of JP-A-2000-243495 employing the square wire members, the holding of the terminal on the housing is maintained by the press-fitting of the terminal in the terminal holding hole (formed through the terminal holding wall of the connector housing) and the biting engagement of the first and second projections of the terminal. The amount of biting is large, and therefore the holding is positively effected. On the other hand, a large load is encountered when inserting the terminal into the housing since the biting amount is large, and therefore the speed of insertion of the terminal is inevitably lowered. And besides, the terminal has a complicated shape, and therefore it is difficult to precisely form or shape the terminal. To enlarge the terminal holding hole is effective as a countermeasure to deal with the lowered terminal-inserting speed. However, the terminal holding force is lowered as a result of enlarging the terminal holding hole.

SUMMARY OF THE INVENTION

It is an object of this invention to provide a terminal holding structure of a board mounted-type connector in which terminals can be positively retained with a simple structure without lowering a terminal holding force.

The above object has been achieved by a terminal holding structure of a board mounted-type connector comprising a connector housing having a terminal holding wall, and board mounted-type terminals which are press-fitted respectively in terminal holding holes formed through the terminal holding wall, and are retained at their respective retaining portions in the terminal retaining holes, respectively; characterized in that the retaining portion of the board mounted-type terminal includes a pair of rear retaining projections which are formed on and project laterally respectively from opposite sides of the board mounted-type terminal so as to be pressed respectively into opposed side surfaces of the terminal holding hole, and a pair of front retaining projections which are formed on and project laterally respectively from the opposite sides of the board mounted-type terminal so as to be pressed respectively into the opposed side surfaces of the terminal holding hole, and are disposed rearwardly of the rear retaining projections in a direction of press-fitting of the board mounted-type terminal; and the rear retaining projections and the front retaining projections are different in shape from each other.

In the above construction, preferably, a dimension X of the front retaining projection in a direction of a height of the side surface is smaller than a dimension X' of the rear retaining projection in the direction of the height of the side surface, and a dimension Y between outer ends of the pair of front retaining projections in a direction parallel to a bottom surface of the terminal holding hole is larger than a dimension Y' between outer ends of the pair of rear retaining projections in the direction parallel to the bottom surface of the terminal holding hole.

Preferably, the rear retaining projection has a groove of a V-shaped cross-section formed in its outer end surface which is opposed to the side surface of the terminal holding hole when the board mounted-type terminal is press-fitted in the terminal holding hole, and the front retaining projection has a groove of a V-shaped cross-section formed in its outer end surface which is opposed to the side surface of the terminal holding hole when the board mounted-type terminal is press-fitted in the terminal holding hole, and a bottom line of each of the grooves, formed in the rear and front retaining projections, is disposed parallel to a longitudinal axis of the board mounted-type terminal.

In the present invention, the board mounted-type terminal has the simple shape, and therefore can be easily formed or shaped, and besides since the front retaining projections and the rear retaining projections are different in shape from each other, the terminal can be highly effectively retained in the housing, and also the shaking of the terminal in the upward, downward, left and right directions is suppressed.

DETAILED DESCRIPTION OF THE PREFERRED EMBODIMENTS

Figure 1:
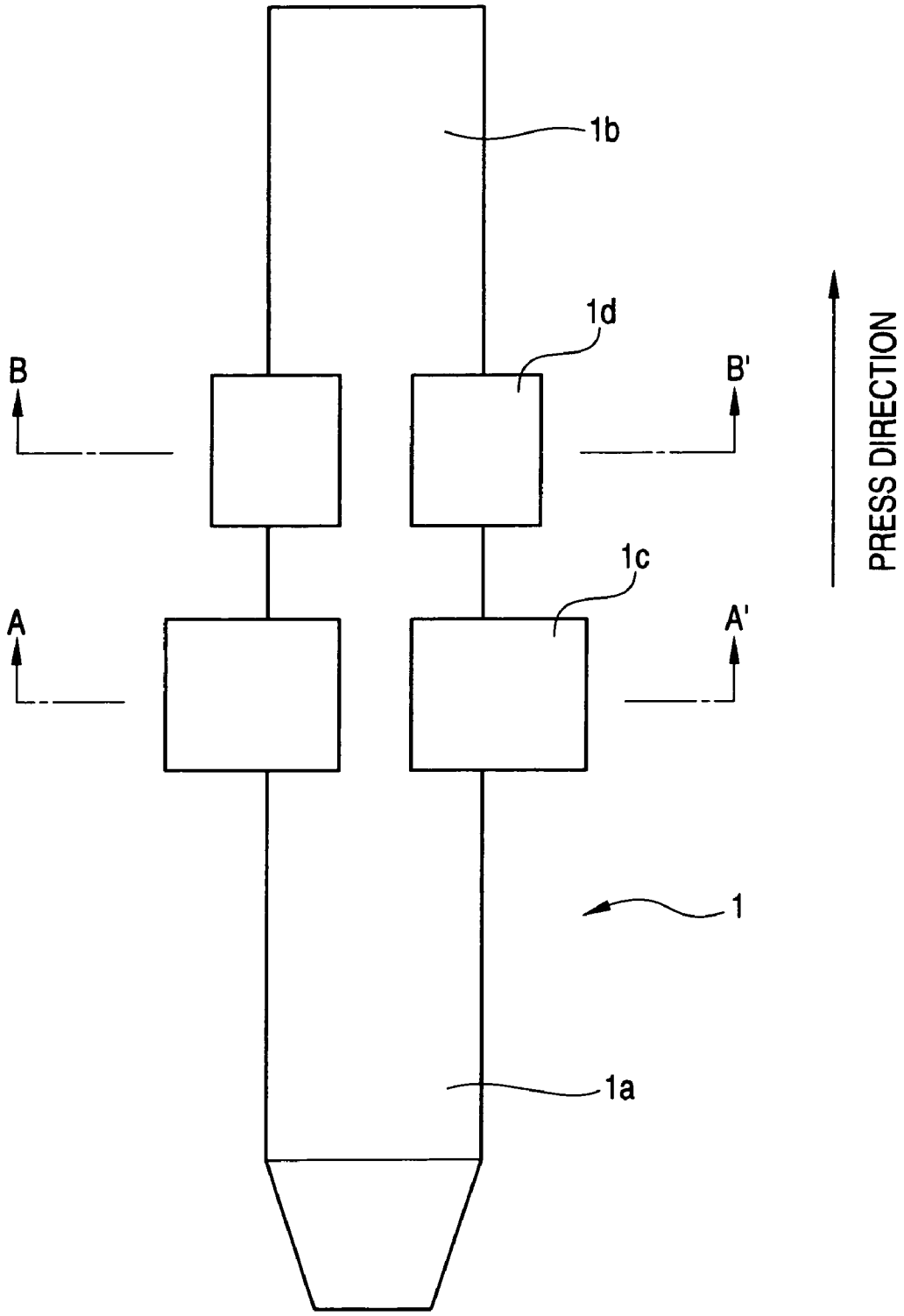
FIG. 1 is a plan view of a preferred embodiment of a board mounted-type terminal of the present invention.
Figure 6:
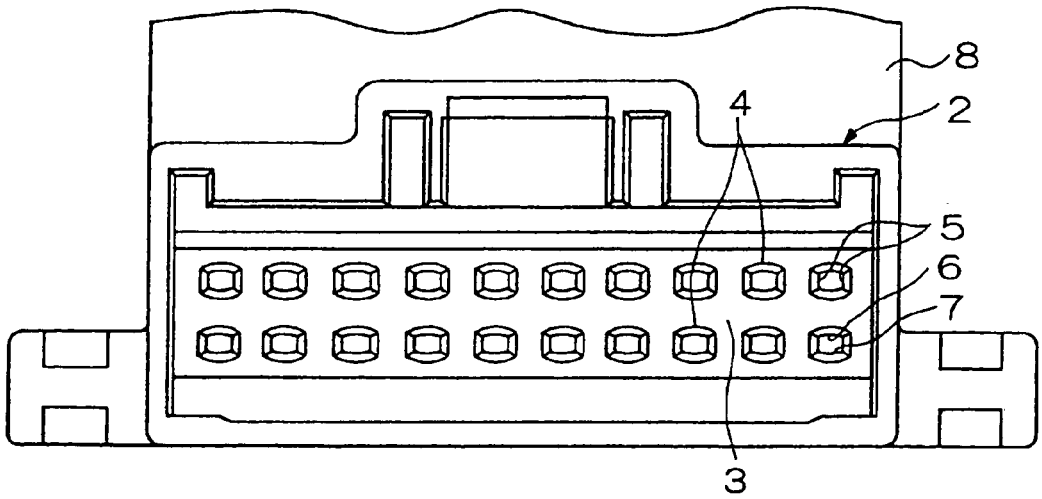
FIG. 6 is a front-elevational view of the connector housing into which the board mounted-type terminals of the above embodiment are to be press-fitted.

A preferred embodiment of a terminal holding structure of a board mounted-type connector of the present invention will now be described with reference to the drawings. Each of board mounted-type terminals 1, used in the terminal holding structure of the board mounted-type connector of this embodiment, comprises a square wire member, and these terminals 1 are press-fitted and held in a plurality of terminal holding holes 4 formed through a terminal holding wall 3 of a connector housing 2 shown in FIG. 6. As shown in FIG. 1, the board mounted-type terminal 1 of this embodiment has a front electrical contact portion 1*a* formed at a front portion thereof (which is a rear portion with respect to a direction of press-fitting of the terminal), and this electrical contact portion 1*a* can be electrically connected to a electrical contact portion of a mating connector. A rear electrical contact portion 1*b* is formed at a rear portion thereof (which is a front portion with respect to the direction of press-fitting of the terminal) of this terminal, and is passed through a board 8 mounted at a rear side of the connector housing 2, and is soldered to a circuit pattern on a rear surface of this board 8. Each terminal holding hole 4 has a rectangular cross-section defined by opposite side surfaces 5, a top surface 6 and a bottom surface 7, and the board mounted-type terminal 1, formed using a square wire material, is adapted to be press-fitted in the terminal holding hole 4.

Figure 2:
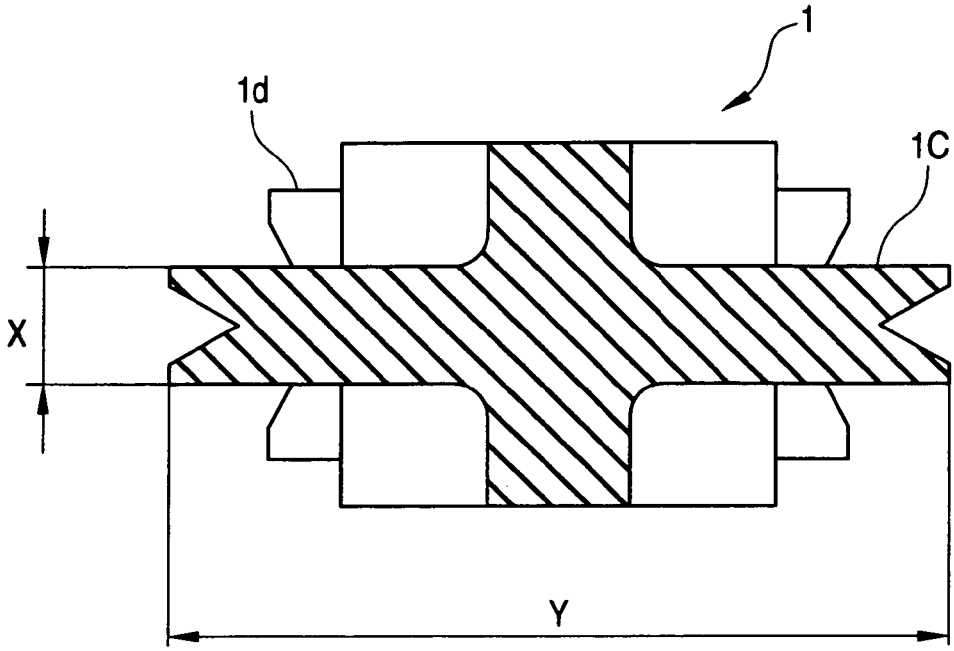
FIG. 2 is a cross-sectional view, showing front retaining projections of the board mounted-type terminal of FIG. 1.
Figure 3:
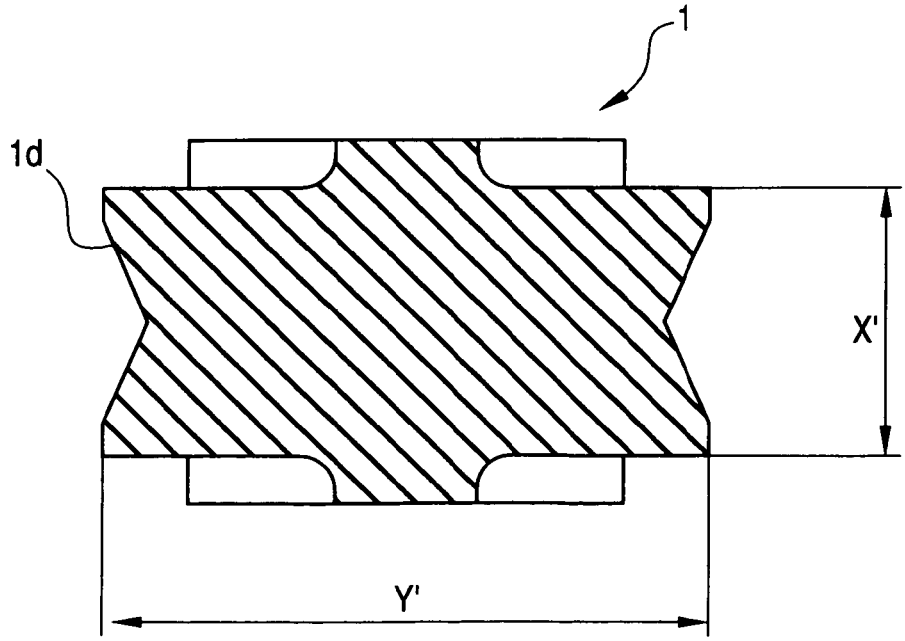
FIG. 3 is a cross-sectional view, showing rear retaining projections of the board mounted-type terminal of FIG. 1.

The board mounted-type terminal 1 has a retaining portion formed between the front electrical contact portion 1*a* and the rear electrical contact portion 1*b*, and this retaining portion is adapted to be held or retained in the terminal holding hole 4. This retaining portion includes a pair of rear retaining projections 1*d* disposed close to the rear electrical contact portion 1*b*, and a pair of front retaining projections 1*c* disposed close to the front electrical contact portion 1*a* (that is, disposed rearwardly of the rear retaining projections 1*d* in the direction of press-fitting of the terminal 1). As shown in FIG. 2 which is a cross-sectional view taken along the line A–A' of FIG. 1, the front retaining projections (projecting portions) 1*c* project laterally respectively from opposite sides of the board mounted-type terminal 1 in a symmetrical manner, and have the same square shape. A groove of a V-shaped cross-section is formed in an outer end of each of the front retaining projections 1*c*, and a bottom line of the groove is disposed parallel to a longitudinal axis of the board mounted-type terminal 1. As shown in FIG. 3 which is a cross-sectional view taken along the line B–B' of FIG. 1, the rear retaining projections (projecting portions) 1*d* project laterally respectively from the opposite sides of the board mounted-type terminal 1 in a symmetrical manner, and have the same square shape. A groove of a V-shaped cross-section is formed in an outer end of each of the rear retaining projections 1*d*, and a bottom line of the groove is disposed parallel to the longitudinal axis of the board mounted-type terminal 1.

When a dimension of each front retaining projection 1*c* in an upward-downward (or vertical) direction (in FIG. 2) (that is, a dimension of that portion of the front retaining projection 1*c* (biting into the side surface 5 when the board mounted-type terminal 1 is press-fitted in the terminal holding hole 4) in a direction of the height of the side surface 5) is represented by X, while a dimension of each rear retaining projection 1*d* in the upward-downward direction (in FIG. 3) (that is, a dimension of that portion of the rear retaining projection 1*d* (biting into the side surface 5 when the board mounted-type terminal 1 is press-fitted in the terminal holding hole 4) in the direction of the height of the side surface 5) is represented by X', then the relation, X<x', is established. Also, when a dimension between the outer ends of the pair of front retaining projections 1*c* in a horizontal direction (in FIG. 2) is represented by Y, while a dimension between the outer ends of the pair of rear retaining projections 1*d* in the horizontal direction (in FIG. 3) is represented by Y', the relation, Y>Y', is established. The front retaining projections 1*c* and the rear retaining projections 1*d* are different from each other in these respects.

When the height of each side surface 5 of the terminal holding hole 4 is represented by $X_0$, it will be readily appreciated that the relation, $X_0$>X', is established. When a width of the bottom surface 7 (and hence a width of the top surface 6) of the terminal holding hole 4 is represented by $Y_0$, the relation, $Y_0$<Y', is established. When the board mounted-type terminal 1 is press-fitted into the terminal holding hole 4, the outer ends (distal ends) of the front retaining projections 1*c*, as well as the outer ends (distal ends) of the rear retaining projections 1*d*, bite respectively into the opposed side surfaces 5 of the terminal holding hole 4, thereby holding or retaining the board mounted-type terminal 1 in the terminal holding wall 3.

Figure 4:
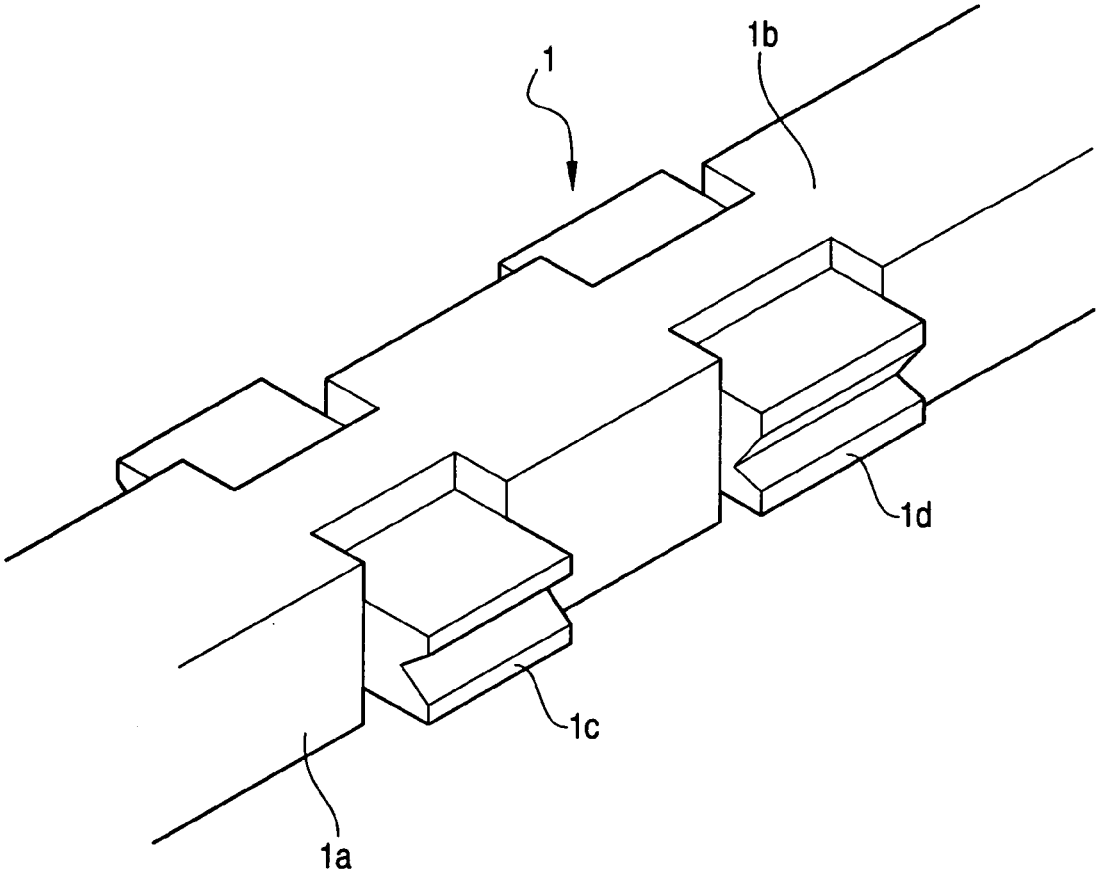
FIG. 4 is a perspective view showing a retaining portion of the board mounted-type terminal of FIG. 1.
Figure 5:
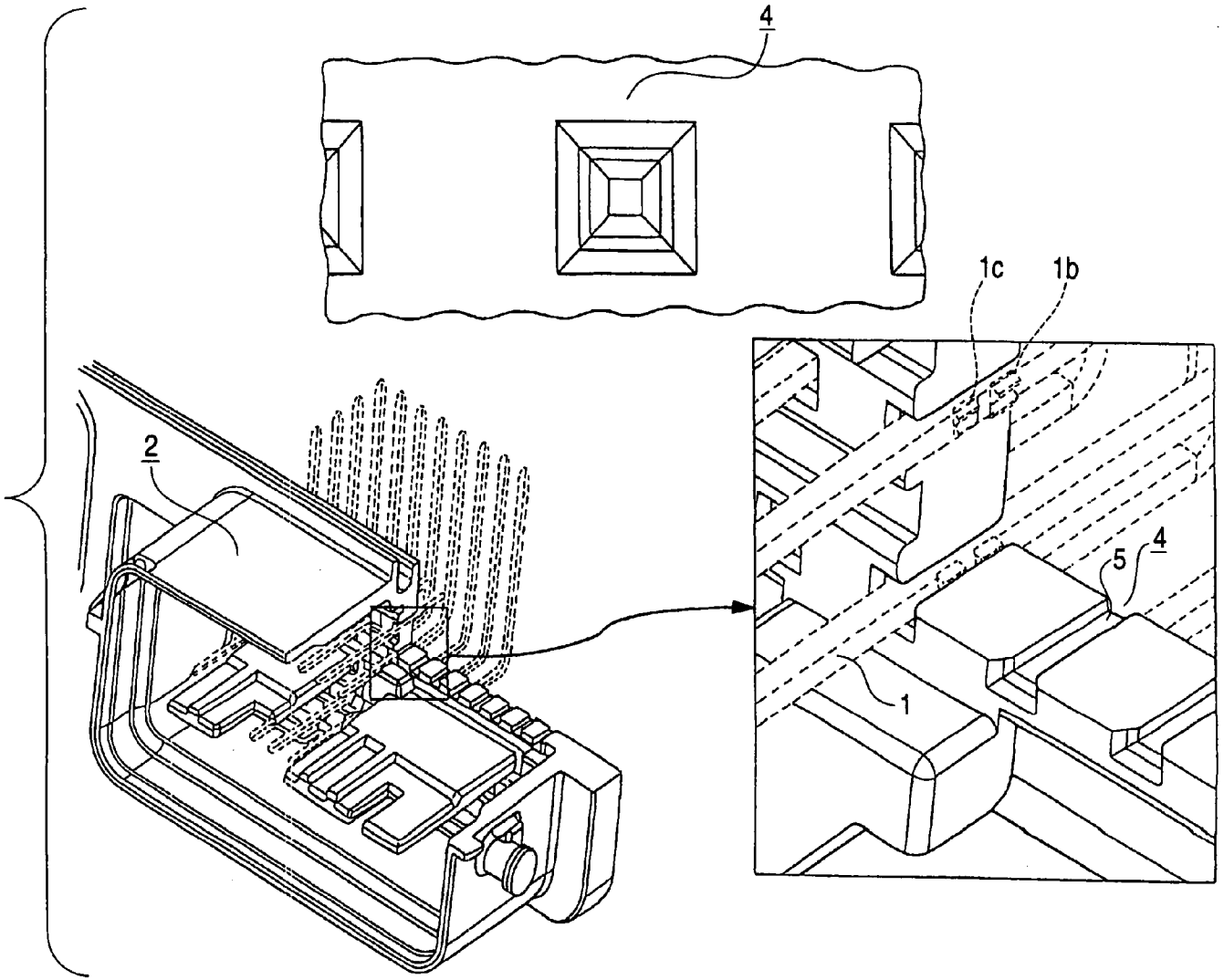
FIG. 5 is a partly-broken perspective view showing terminal holding holes of a connector housing into which the board mounted-type terminals of the above embodiment are to be press-fitted, respectively.

FIG. 4 is a perspective view showing the retaining portion of the board mounted-type terminal 1. FIG. 5 is a partly-broken perspective view showing the terminal holding holes 4 formed through the terminal holding wall 3 of the connector housing 2. When the board mounted-type terminal 1 is press-fitted into the terminal holding hole 4, each rear retaining projection 1*d* thereof bites relatively shallow into the side surface 5 over a wide area, while each front retaining projection 1*c* thereof bites relatively deep into the side surface 5 over a narrow area (since the relation, $Y_0$<Y'<Y, is established as described above), and therefore the front and rear retaining projections achieve the effective interference fit effect, thereby holding or retaining the board mounted-type terminal 1 on the connector housing 2.

Even when the shape of the front retaining projections 1*c* and the shape of the rear retaining projections 1*d* are replaced with each other, similar advantageous effects as described above can be achieved. In the case where a pair of front retaining projections and a pair of rear retaining projections (which are identical in cross-sectional shape to each other, and are so arranged that each front retaining projection and the corresponding rear retaining projection can be disposed generally at the same position relative to the corresponding side surface of the terminal holding hole) are formed respectively at two portions of a board mounted-type terminal which are disposed on a common line, and are spaced from each other in a terminal press-fitting direction, the side surfaces 5 of the terminal holding hole 4 are plastically deformed respectively by the leading rear retaining projections when the board mounted-type terminal is press-fitted into the terminal holding hole, and then the following front retaining projections are brought into biting engagement with the plastically-deformed side surfaces, respectively, and therefore there is a fear that the retaining forces, applied from the front retaining projections to the side surfaces, are insufficient. In the above embodiment, however, the front retaining projections 1*c* and the rear retaining projections 1*d* are different in shape from each other, and therefore the above fear is eliminated.

In this embodiment, the retaining portion has the simple shape, and therefore the forming or shaping of the board mounted-type terminal can be effected easily. The front retaining projections 1*c* and the rear retaining projections 1*d* are different in shape and size from each other, and therefore when the terminal is press-fitted into the terminal holding hole, each front retaining projection 1*c* and the corresponding rear retaining projection 1*d* are brought into biting and retaining engagement with different portions of the terminal holding wall 3, respectively, and therefore there is obtained the excellent effect of retaining the terminal in the connector housing, and besides there is obtained the effect of suppressing the shaking of the terminal in the upward, downward, left and right directions.

What is claimed is:

1. A board mounted-type terminal for a board mounted-type connector comprising:

a retaining portion of said board mounted-type terminal including:

a pair of rear retaining projections formed on and projecting laterally, respectively, in a lateral direction from opposite sides of said board mounted-type terminal so as to be pressed respectively into opposed side surfaces of a terminal holding hole provided with a connector housing to be adapted, and a pair of front retaining projections formed on and project laterally, respectively, in the lateral direction from the opposite sides of said board mounted-type terminal so as to be pressed respectively into the opposed side surfaces of a terminal holding hole of said connector housing to be adapted, and said front retaining projections disposed rearwardly of said rear retaining projections in a direction of press-fitting of said board mounted-type terminal, wherein said rear retaining projections and said front retaining projections are different in shape from each other, and wherein a dimension X of said front retaining projection in a direction of a height of said side surface is smaller than a dimension X' of said rear retaining projection in the direction of the height of said side surface, and a dimension Y between outer ends of said pair of front retaining projections in the lateral direction parallel to a bottom surface of said terminal holding hole is larger than a dimension Y' between outer ends of said pair of rear retaining projections in the lateral direction parallel to the bottom surface of said terminal holding hole.

2. A board mounted-type terminal according to claim 1, wherein said rear retaining projection has a groove of a V-shaped cross-section formed in its outer end surface which is opposed to the side surface of said terminal holding hole when said board mounted-type terminal is press-fitted in said terminal holding hole, wherein said front retaining projection has a groove of a V-shaped cross-section formed in its outer end surface which is opposed to the side surface of said terminal holding hole when said board mounted-type terminal is press-fitted in said terminal holding hole, and wherein a bottom line of each of said grooves, formed in said rear and front retaining projections, is disposed parallel to a longitudinal axis of said board mounted-type terminal.

3. A terminal holding structure of a board mounted-type connector comprising:

a connector housing having a terminal holding wall, and board mounted-type terminals press-fitted respectively in terminal holding holes formed through said terminal holding wall, and retained at their respective retaining portions in said terminal retaining holes, respectively, said retaining portion of said board mounted-type terminal including:

a pair of rear retaining projections formed on and projecting laterally, respectively, in a lateral direction from opposite sides of said board mounted-type terminal so as to be pressed respectively into opposed side surfaces of said terminal holding hole, and a pair of front retaining projections formed on and projecting laterally, respectively, in a lateral direction from the opposite sides of said board mounted-type terminal so as to be pressed respectively into the opposed side surfaces of said terminal holding hole, and said front retaining projections disposed rearwardly of said rear retaining projections in a direction of press-fitting of said board mounted-type terminal, wherein said rear retaining projections and said front retaining projections are different in shape from each other and wherein a dimension X of said front retaining projection in a direction of a height of said side surface is smaller than a dimension X' of said rear retaining projection in the direction of the height of said side surface, and a dimension Y between outer ends of said pair of front retaining projections in the lateral direction parallel to a bottom surface of said terminal holding hole is larger than a dimension Y' between outer ends of said pair of rear retaining projections in the lateral direction parallel to the bottom surface of said terminal holding hole.

4. A board mounted-type terminal according to claim 3, wherein said rear retaining projection has a groove of a V-shaped cross-section formed in its outer end surface which is opposed to the side surface of said terminal holding hole when said board mounted-type terminal is press-fitted in said terminal holding hole, wherein said front retaining projection has a groove of a V-shaped cross-section formed in its outer end surface which is opposed to the side surface of said terminal holding hole when said board mounted-type terminal is press-fitted in said terminal holding hole, and wherein a bottom line of each of said grooves, formed in said rear and front retaining projections, is disposed parallel to a longitudinal axis of said board mounted-type terminal.

* * * * *